US006938287B1

(12) United States Patent
Mahshie

(10) Patent No.: US 6,938,287 B1
(45) Date of Patent: Sep. 6, 2005

(54) LOUNGE CHAIR WITH BODY-ACCOMMODATING OPENINGS

(76) Inventor: John S. Mahshie, 625 Cape Ter., Port Charlotte, FL (US) 33952

( * ) Notice: Subject to any disclaimer, the term of this patent is extended or adjusted under 35 U.S.C. 154(b) by 0 days.

(21) Appl. No.: 10/670,672

(22) Filed: Sep. 25, 2003

Related U.S. Application Data

(60) Provisional application No. 60/413,344, filed on Sep. 25, 2002.

(51) Int. Cl.[7] ..... A47C 17/66
(52) U.S. Cl. ..... 5/111; 5/735; 297/900
(58) Field of Search ..... 297/900; 5/110–112, 5/735, 631, 930, 656, 725, 638

(56) References Cited

U.S. PATENT DOCUMENTS 5,029,349 A * 7/1991 Hamilton ..... 5/111
5,222,779 A * 6/1993 Johnson ..... 5/656
D357,538 S * 4/1995 Sockwell, II et al. ..... D24/183
5,946,749 A * 9/1999 Sewell ..... 5/110
5,950,259 A * 9/1999 Boggs ..... 5/111
6,295,668 B1 * 10/2001 Nation ..... 5/110

* cited by examiner

*Primary Examiner*—Sunil Singh
(74) *Attorney, Agent, or Firm*—William E. Noonan

(57) ABSTRACT

A beach or lounge chair includes a generally horizontal component for supporting a user thereon and a leg assembly for holding the supportive component above the ground. The supportive component includes a first opening for accommodating the breasts of a female user. A pocket is attached to and depends from the lower side of the supportive component beneath the opening. The pocket accommodates and obscures the breasts of a user lying face down in a prone position on the support chair. Pressure on the breasts is thereby alleviated.

19 Claims, 4 Drawing Sheets

LOUNGE CHAIR WITH BODY-ACCOMMODATING OPENINGS

RELATED APPLICATION

This application claims the benefit of U.S. Provisional Application Ser. No. 60/413,344, filed Sep. 25, 2002.

FIELD OF THE INVENTION

This invention relates to a lounge chair having a pocket for accommodating the breasts of a female user and also having an aperture for receiving at least a portion of the user's face.

BACKGROUND OF THE INVENTION

Many types of folding lounge chairs are available for use at the beach, pool, backyard and elsewhere. Women often find these products to be quite uncomfortable to use. When a woman lays face down on the open chair, her breasts are pressed firmly against the supporting surface of the chair. This surface may be composed of a wide variety of materials including, but not limited to, plastic, fabric and canvass. Although a pad or cushion can be employed in some cases, the pressure applied against the breasts is almost always fairly uncomfortable, particularly for women having naturally large or surgically enhanced bust lines.

Previously available mats and mattresses have employed a recess for accommodating a female user's breasts. To date, however, no such feature has been utilized on a lounge or beach chair. Moreover, even in the known recessed products, the user's breasts typically directly engage and press against the material of the mat or pad within the recess. As a result, at least some degree of pressure is exerted upon the breasts and some discomfort is experienced.

It is also often difficult for a person using a conventional lounge chair to comfortably read a book or magazine while the person is lying face down. Typically, the book must be propped up and the reader must raise his or her head in such a way that the neck is bent upwardly at an awkward angle. This position can be quite uncomfortable and usually can be maintained for only a short period of time before the person must change position on the lounge chair. As a result, in situations where the person is sunbathing, he or she is usually not able to lay face down for a time sufficient to achieve an even tan.

SUMMARY OF THE INVENTION

It is therefore an object of the present invention to provide an improved lounge chair that may be used quite comfortably by a woman lying face down, without exerting virtually any pressure against the woman's breasts.

It is a further object of this invention to provide a lounge chair which is much more comfortable for women to use than known lounge chairs.

It is a further object of this invention to provide a lounge chair that comfortably accommodates a woman's breasts while hiding the breasts from view so that the user's privacy is protected.

It is a further object of this invention to provide a lounge chair which permits the user to read comfortably while lying face down for an extended period of time.

It is a further object of this invention to provide a lounge chair that permits the user to read while lying face down without having to awkwardly and uncomfortably bend his or her neck.

It is a further object of this invention to provide a lounge chair having the foregoing advantages and also being extremely lightweight and conveniently foldable so that it may be readily transported for use at a desired location.

It is a further object of this invention to provide a lounge chair that is comfortable and convenient for use at the beach, pool, backyard and elsewhere.

This invention results from a realization that a woman may lie face down on a lounge chair without experiencing uncomfortable chest pressure and with her privacy protected by providing the supporting surface of the chair with an opening for accommodating the breasts and a pocket that hangs below the opening for hiding the breasts from view.

This invention features a lounge chair that includes a generally horizontal support surface for supporting a user thereon and a leg assembly for holding the support surface above the ground, floor or other generally horizontal surface. The support surface includes an opening proximate one end of the support surface for accommodating the breasts of a female user. A pocket is attached to and depends from a lower side of the support surface beneath the opening. The pocket accommodates and obscures the breasts of a user lying face down in a prone position on the support surface. That user's breasts extend through the opening and into the pocket. The pocket is made large enough so that the breasts do not directly engage the pocket and therefore pressure is not exerted on the breasts by the pocket. The pocket also serves to accommodate various beach accessories and other personal items (e.g. sun glasses, sun tan lotion, keys, etc.).

In a preferred embodiment, the support surface also includes an aperture for accommodating the user's eyes and at least a substantial portion of the user's face including the mouth and nose. Typically, the aperture may have an oval shape although other configurations such as a T-shape may also be employed.

The support surface may include multiple, foldably interconnected segments. In particular, the support surface may include an intermediate segment and upper and lower segments foldably joined to the intermediate segment. The upper segment may include the breast and face-accommodating openings.

Assorted types of supporting legs may be utilized. For example, the chair may have generally U-shaped tubular legs formed between each adjacent pair of support segments. Alternatively, individual elongate legs may be attached to and extend downwardly from the support surface at various selected locations.

The face-accommodating aperture may be positioned slightly above a book holder that is supported and depends from the bottom of the body supporting section. The book holder may include a flexibly foldable rack.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
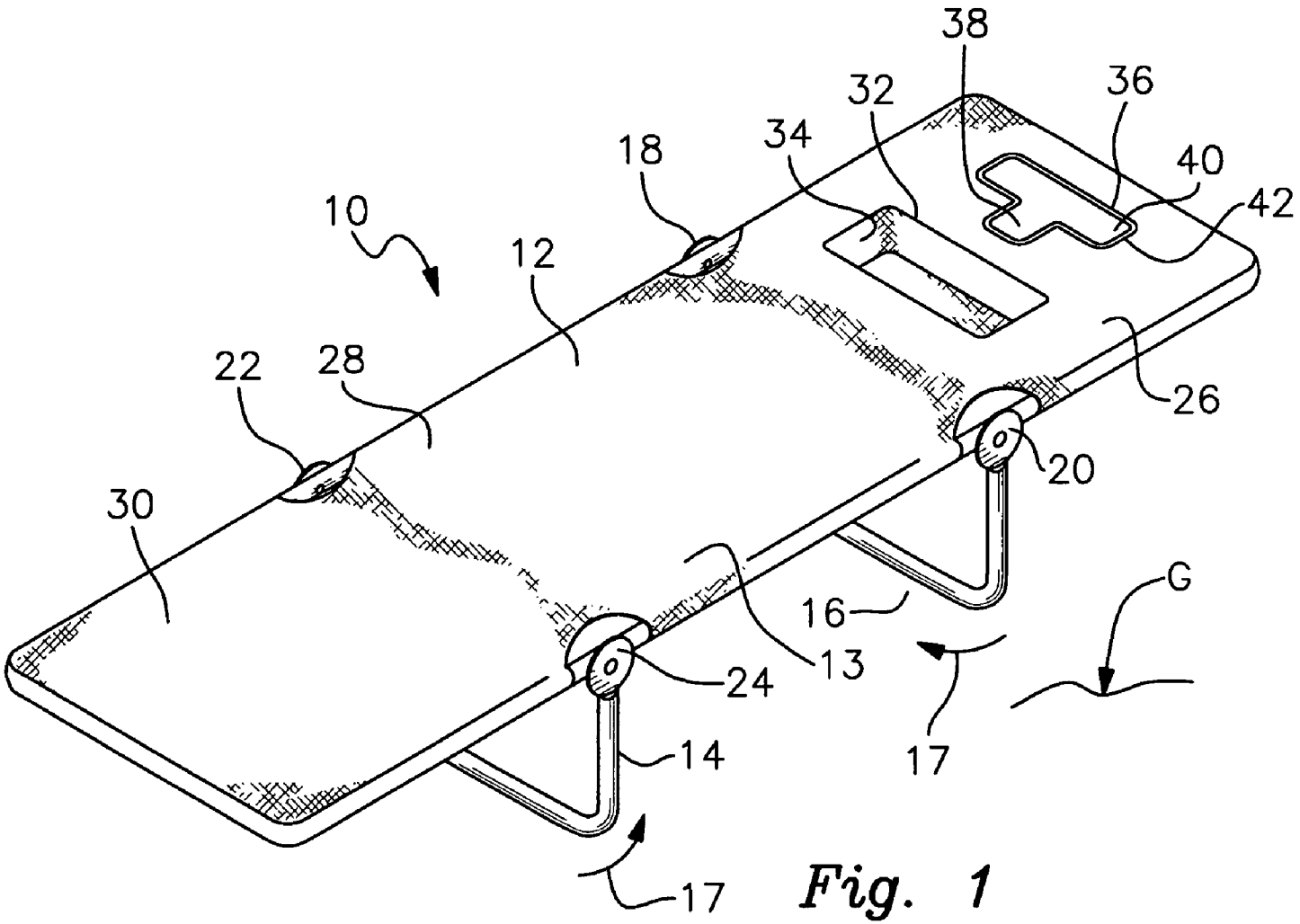
FIG. 1 is an upper perspective view of a preferred lounge chair according to this invention.
Figure 2:
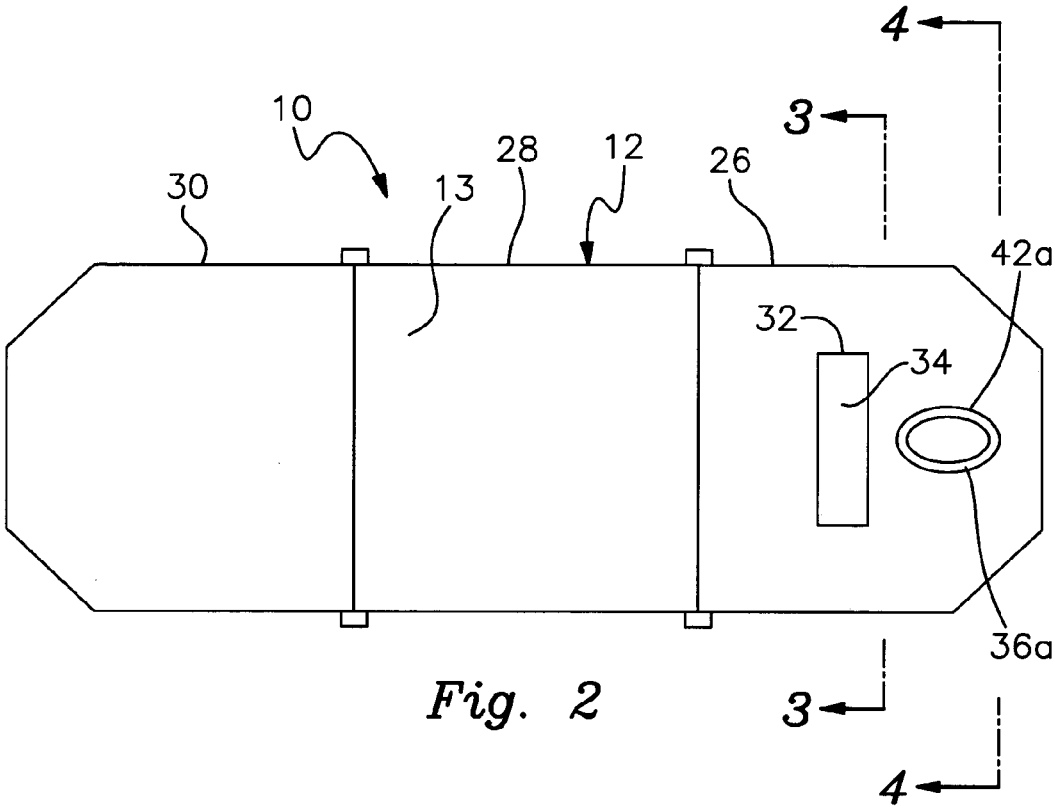
FIG. 2 is a top plan view of a slightly modified version of the lounge chair, which includes a generally oval shaped face-accommodating aperture.

There is shown in FIGS. 1 and 2, two slightly different versions of a lounge chair 10 according to this invention. A foldable version of the lounge chair is particularly preferred for use at the beach. Alternatively, a non-foldable, one-piece unit may be preferably employed on a patio or pool deck, indoors, in a backyard or elsewhere. The chair may be used in or around virtually any indoor or outdoor location within the scope of this invention.

Figure 3:
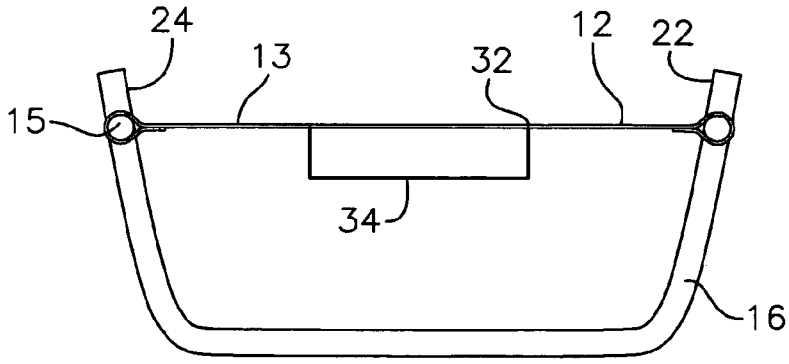
FIG. 3 is an end, elevational view taken along line 3—3 of FIG. 2.

As shown in FIGS. 1–3, chair 10 includes an elongate, generally horizontal body support 12, which is held above the ground G by a pair of generally U-shaped leg components 14 and 16. It should be understood that the support and legs of the lounge chair are constructed in any one of a variety of well known ways. For example, the legs may be composed of aluminum tubing. The body support comprises a flexible and preferably soft supportive element 13 that is secured to a peripheral aluminum frame 15 (obscured in FIGS. 1 and 2). As best shown in FIG. 3, element 13 comprises a thin flexible element, which may be composed of various materials including but not limited to plastic, canvas, cloth fabric, padded material, etc. The peripheral edge of element 13 is wrapped about tubular frame 15 and secured to itself by stitching or other conventional means of attachment such that the tubular frame extends through a peripheral channel in the horizontal supportive element 13. The U-shaped legs 14 and 16 are secured hingedly to the horizontal frame 15 in a conventional manner. The legs are selectively foldable relative to the frame as indicated by arrows 17. In certain versions, a concave (downwardly curved) support bar (not shown) may extend transversely between the upper ends of the U-shaped legs. This strengthens the legs.

As best shown in FIG. 2, body support 12 includes three longitudinally interconnected segments 26, 28 and 30 arranged generally head-to-toe. Segment 26 is hingedly interconnected to intermediate segment 28 by conventional hinge components 18 and 20 represented generally in FIG. 1. Segment 30 is similarly connected to the opposite end of segment 28 by hinge components 22 and 24. It should be understood that a wide variety of pivotable or folding interconnections may be employed in the chair. The particular construction utilized to render the chair collapsible will be well known to person skilled in the art of beach and lounge chairs and does not constitute a part of this invention. It should also be understood that in certain embodiments, the horizontal body support 12 is constructed as a single fixed piece or unit without exhibiting the folding feature.

A pair of openings are formed proximate the upper end of body support 12. In particular, a breast accommodating opening 32 is formed in segment 26 of support 12. Opening 32 is formed by cutting a rectangular, oblong or other laterally extending hole in supportive element 13 of horizontal body support 12. Opening 32 may be reinforced along its peripheral edge by stitching, backing or other conventional means. A relatively deep pocket 34 is attached to and depends 4½" to 5½" inches from the bottom surface of supportive element 13 directly beneath opening 32. The pocket comprises a thin, lightweight, flexible material that collapses into a generally flat condition when the chair is folded for transport or storage. When the chair is fully opened in the manner shown in the drawings, pocket 34 hangs loosely beneath the supportive element such that it registers with the breast-accommodating opening. The pocket may have separate and distinct bottom and side walls or, alternatively, may comprise a pocket without precisely defined or separated walls.

A face-accommodating aperture 36, FIG. 1, is also formed through supportive element 13 of support 12. The face-accommodating aperture is located between breast accommodating opening 32 and the upper end of the chair. In FIG. 1, a generally T-shaped opening is formed. The vertical portion 38 of the "T" accommodates the user's mouth and the horizontal or crossbar portion 40 of the opening accommodates the user's eyes. A seam or border 42, comprising a relatively soft and comfortable material such as cotton or other soft fabric, is formed about the periphery or boundary of aperture 36.

A differently shaped face-accommodating aperture 36*a* is depicted in FIG. 2. Therein, the opening comprises an oval or rounded shape. A wide variety of other shapes may be employed for the face-accommodating aperture in addition to the shapes shown herein. In all cases, the opening should be large enough for the user's mouth, nose and eyes to comfortably engage the opening without interference from the supportive element. Adequate clearance must be provided to allow the user to breath through the aperture. At the same time, it is desirable for the user to be able to see through the face-accommodating aperture 36 so that a book or magazine may be read in a manner described more fully below. Once again, in the embodiment of FIG. 2, the periphery of aperture 36*a* is surrounded by a border or seam 42, which comprises a soft material that is comfortably engagable with the user's face. Except for the differently shaped face-accommodating apertures, the embodiments shown in FIGS. 1 and 2 are constructed and operate in a virtually identical manner. Corresponding elements are therefore assigned like reference numerals.

Figure 4:
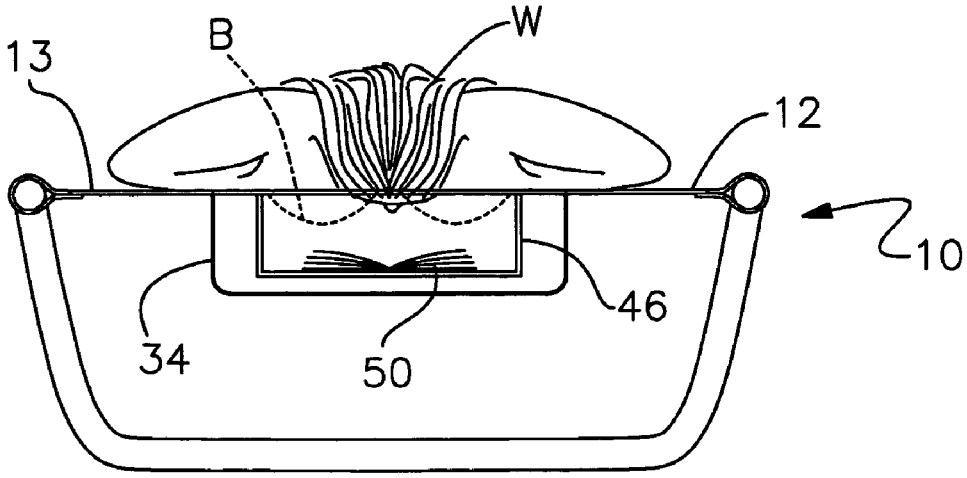
FIG. 4 is an elevational view taken along line 4—4 of FIG. 2 and further depicting a female user lying face down on the lounge chair and reading a book or magazine mounted on an optional book holder that depends from the chair.
Figure 5:
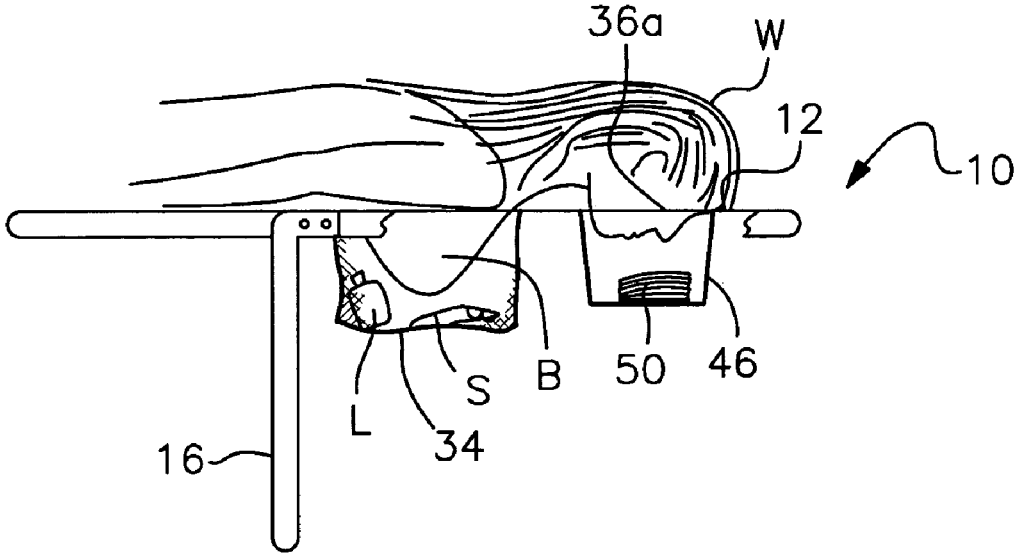
FIG. 5 is an elevational side view of the upper end portion of the lounge chair with a female user lying face down thereon and with accessories disposed within the breast pocket.

The lounge chair of this invention is particularly intended for use by a woman and is especially advantageous for use by women having naturally or surgically enhanced breasts. As shown in FIGS. 4 and 5, a woman W lies face down upon the supportive element 13 of chair 10. Woman W positions herself on the chair such that her breasts B hang freely through opening 32 and into pocket 34. No pressure whatsoever is applied against the breasts. As a result, the female is user is able to lie face down upon the chair much more comfortably than in known lounge and beach chairs. To achieve this benefit, it is particularly preferred that there be some clearance between the breasts and the bottom of the pocket. The precise distance may be varied within the scope of this invention. The pocket should be large enough so that, in addition to providing ample clearance for the user's breasts, the pocket is also able to accommodate various accessories and personal items such as sunglasses S, suntan lotion L, keys, etc. (FIG. 5). The sides and bottom of pocket 34 should be composed of a solid, opaque material so that the user's breasts are hidden within the pocket. This protects the user's privacy.

As best shown in FIGS. 4 and 5, an optional book supporting rack 46 is attached to and depends from the bottom of supportive element 13 beneath face-accommodating aperture 36*a*. Rack 46 may comprise a flexible fabric or strap-like material similar to that comprising the pocket. It may alternatively comprise a stiffer or more rigid material. Unlike the pocket, one or more sides are open so that a book can be conveniently inserted into the rack and illuminated for reading by ambient light. Preferably, the rack is foldable with the lounge chair. As shown in FIGS. 4 and 5, a book or magazine 50 is supported by the rack such that the woman W using the chair is able to read the book or magazine 50 through the face-accommodating aperture 36 when her face is positioned against the aperture. This allows the user to conveniently read while reclining on the lounge. The user turns the pages of the book by simply reaching over the end of and beneath the lounge chair and turning the pages as required.

Figure 6:
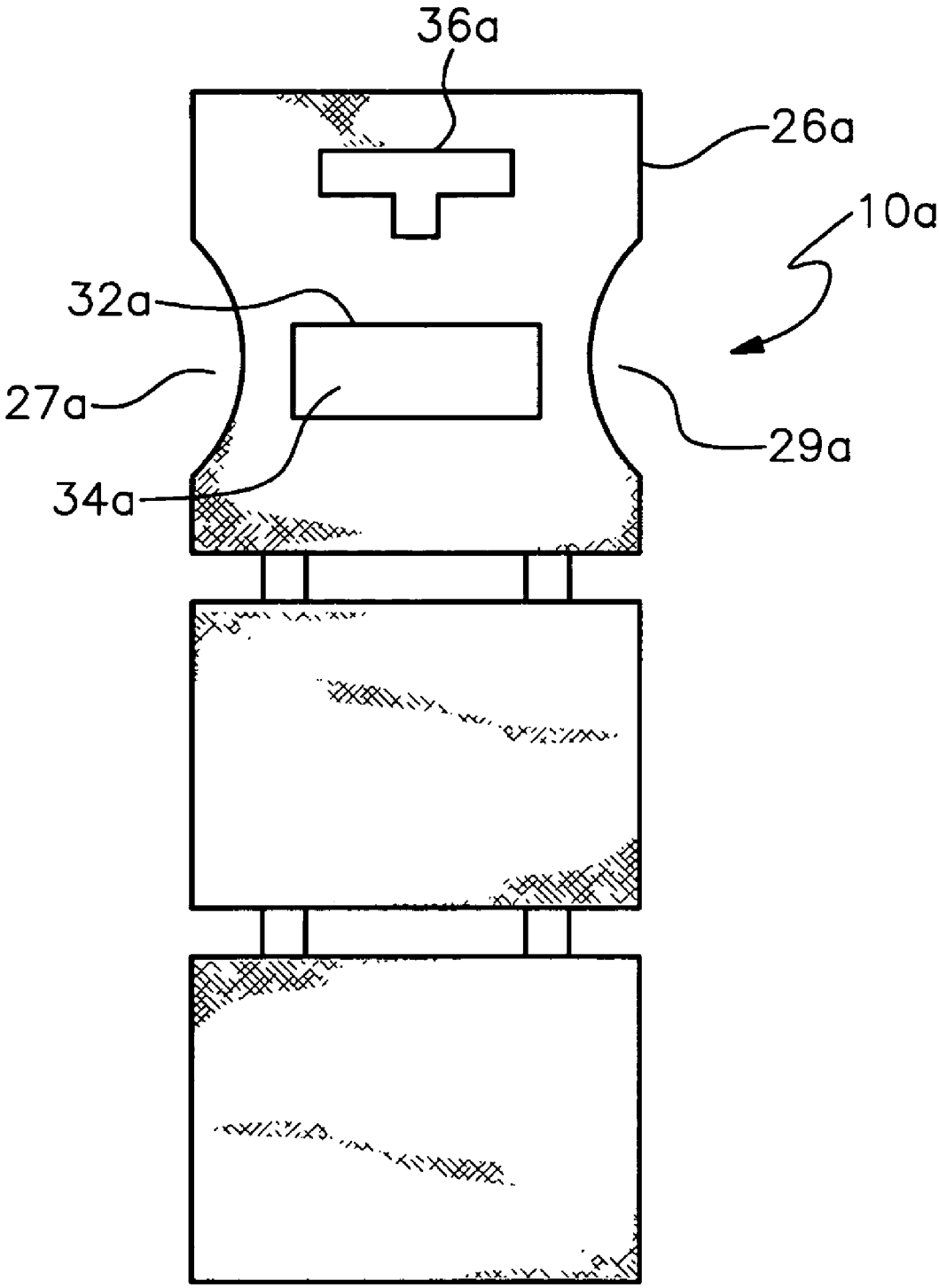
FIG. 6 is a top view of an alternative lounge chair according to this invention.

As shown in FIG. 6, alternative lounge chair 10*a* is provided with recessed side edges 27*a* and 29*a* in upper or head section 26*a*. A user lies prone on the chair and places his or her head against aperture 36*a*. A female user's breasts hang within pocket 34*a* below opening 32*a*. A book or other reading matter is placed in the rack below aperture 36*a* in the manner previously described. The recesses 27*a* and 29*a* enable the user to more conveniently manipulate his or her arms to turn the pages of the reading material.

Accordingly, lounge chair 12 enables a woman to lay comfortably in a prone, face down position against the chair for an extended period of time. Pressure against the woman's breasts is relieved due to the opening 32 and pocket 34 and comfort is thereby improved considerably. At the same time, the user is able to comfortably read a book or magazine without cricking, craning or otherwise uncomfortably bending her neck. Once again, comfort is improved and the user is able to recline and relax face down on the chair for an extended period of time. This enables the user to achieve an even tan on her back, which is an additional benefit that is not easily achieved using conventional lounge chairs.

From the foregoing it may be seen that the apparatus of this invention provides for a folding lounge chair having a pocket for accommodating the breasts of a female user. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. An outdoor lounge chair comprising:

a generally horizontal body support assembly for supporting a user thereon in a horizontally prone position;

a leg assembly for holding said support assembly above the ground or other like outdoor surface, said support assembly including an opening for receiving the breasts of a female user there-through; and a pocket attached to and depending from a lower side of said support assembly beneath said opening for peripherally surrounding, enclosing and completely obscuring the female user's breast; said pocket including a thin, lightweight, flexibly collapsible material that hangs loosely beneath said support assembly and extends vertically and perpendicularly downwardly from said support assembly; said pocket having a shape nonconforming to that of a female's breasts and being at least 4½" deep whereby clearance is provided between most female users' breasts and a bottom of said pocket so that such breasts do not directly engage the bottom of said pocket and, instead, hang substantially loosely within said pocket without pressure being exerted by said pocket against the breasts, said pocket being large enough for loosely accommodating most users' accessories therein, even when such users lie horizontally prone on said support assembly with their breasts accommodated in said pocket.

2. The chair of claim 1 in which said support surface further includes an aperture positioned on said support assembly for accommodating the user's eyes and at least a substantial portion of the user's face, including the nose and mouth.

3. The chair of claim 2 in which said aperture has an oval configuration.

4. The chair of claim 2 in which said aperture has a T-shaped configuration.

5. The chair of claim 2 further including a reading material holder that is attached to and depends from a bottom surface of said support assembly below said aperture for supporting reading material thereon such that the material may be read through said aperture by a user whose face is engaged with said aperture.

6. The chair of claim 5 in which said holder includes a flexibly foldable rack attached at opposing ends thereof to the lower surface of said support assembly.

7. The chair of claim 5 in which said holder includes an elongate strap and at least one open side for inserting reading material into said holder and allowing the reading material to be conveniently illuminated by ambient light.

8. The chair of claim 1 in which said support assembly includes multiple, foldably interconnected segments.

9. The chair of claim 8 in which a support assembly includes an intermediate support segment and upper and lower support segments foldably joined to the intermediate support segment for supporting the head and legs of the user, respectively.

10. The chair of claim 9 in which said breast receiving opening and said pocket are formed in said upper support segment.

11. The chair of claim 8 in which said thin flexible material of said pocket is collapsible into a generally flat condition at least when said support assembly is folded.

12. The chair of claim 1 in which said pocket is composed of opaque material.

13. An outdoor lounge chair comprising:

a generally horizontal body support assembly for supporting a user thereon in a horizontally prone position;

a leg assembly for holding said support assembly above the ground or the like; said support assembly including an opening for receiving the breasts of a female user therethrough and an aperture positioned on said support assembly for accommodating the user's eyes and at least a substantial portion of the user's face, including the nose and mouth;

a pocket attached to and depending from a lower side of said support assembly beneath said opening for accommodating and obscuring the female user's breasts; said support assembly including an intermediate support segment and upper and lower segments foldably joined to said intermediate support segment for supporting the head and legs of the user respectively, said breast receiving opening and said aperture being formed in said upper support segment;

said pocket being composed of a thin flexible material that is collapsible into a generally flat condition at least when said support assembly is folded and said pocket being composed of an opaque material for completely obscuring the breasts of the user below said support assembly; and a reading material holder that is attached to and depends from the bottom surface of said support assembly below said aperture for supporting reading material such that the material may be read by a user whose face is engaged with said aperture; said holder including an elongate strap having first and second strap segments that are attached directly to and depend perpendicularly and vertically from a lower side of said upper support segment on respective sides of said aperture, and an intermediate strap segment that interconnects the lower ends of said first and second strap segments and extends horizontally beneath said aperture, said holder including at least one open side for inserting reading material into said holder such that the reading material is supportable by said intermediate strap segment of said holder for allowing the reading material to be conveniently illuminated by ambient light;

said first and second strap segments being composed of a flexibly collapsible material that permits the reading material holder to be collapsed into a substantially flattened condition when the upper segment of said support assembly is folded into a juxtaposed condition against one of said intermediate and lower support segments.

14. An outdoor lounge chair comprising:

a generally horizontal body support assembly, said support assembly including an intermediate support segment and upper and lower support segments foldably joined to said intermediate support segment for supporting the head and legs of a user, respectively;

a leg assembly for holding said support assembly above the ground or other like outdoor surface, said support assembly including an opening formed in said upper support segment for receiving the breasts of a female user there-through; and a pocket composed of a thin, lightweight, flexibly collapsible material attached to and depending from a lower side of said upper segment of said support assembly beneath said opening for peripherally surrounding, fully enclosing and completely obscuring from view the female user's breasts, said pocket hanging loosely beneath said support member and extending perpendicularly and vertically downwardly therefrom and having a shape that is non-conforming to a female user's breasts, said flexible material of said pocket being collapsible into a generally flat condition at least when said support assembly is folded with said upper support segment juxtaposed against one of said intermediate and lower support segments.

15. The chair of claim 14 in which said pocket depends at least 4½" beneath said lower side of said support assembly such that the breasts of most female users do not directly engage the bottom of said pocket and, instead, hang substantially loosely within said pocket without pressure being exerted by said pocket against the breasts.

16. The chair of claim 15 in which said pocket includes a capacity for loosely accommodating the accessories of most female users even when such a user is lying prone on said support assembly with the user's breasts accommodated in said pocket.

17. The chair of claim 16 in which said pocket peripherally surrounds said breast receiving opening in said upper support segment.

18. The chair of claim 16 in which said pocket includes a horizontal planar bottom and vertical side walls that interconnect said support assembly to said bottom.

19. The chair of claim 18 in which said pocket has a generally rectangular configuration.

* * * * *